US008163229B2

(12) United States Patent
Funato et al.

(10) Patent No.: US 8,163,229 B2
(45) Date of Patent: Apr. 24, 2012

(54) APPARATUS AND METHOD FOR SUPPORTING CONTINUOUS CASTING NOZZLE, SLIDING NOZZLE SYSTEM AND CONTINUOUS CASTING NOZZLE

(75) Inventors: Junichi Funato, Fukuoka (JP); Teruo Aoki, Fukuoka (JP); Hisatake Okumura, Fukuoka (JP)

(73) Assignee: Krosakiharima Corporation, Fukuoka (JP)

( * ) Notice: Subject to any disclaimer, the term of this patent is extended or adjusted under 35 U.S.C. 154(b) by 67 days.

(21) Appl. No.: 12/698,485

(22) Filed: Feb. 2, 2010

(65) Prior Publication Data

US 2010/0244335 A1 Sep. 30, 2010

(30) Foreign Application Priority Data

Mar. 24, 2009 (JP) ..... 2009-72503

(51) Int. Cl.
*B22D 11/10* (2006.01)

(52) U.S. Cl. ..... 266/44; 222/591; 222/606; 222/607; 164/438

(58) Field of Classification Search ..... 266/44; 222/591, 606, 607; 164/418, 438
See application file for complete search history.

(56) References Cited

U.S. PATENT DOCUMENTS

| | | | | | |
|---|---|---|---|---|---|
| 4,131,220 | A | * | 12/1978 | Bode et al. | 222/607 |
| 4,313,596 | A | * | 2/1982 | King | 266/207 |
| 4,316,561 | A | * | 2/1982 | Grosko | 222/606 |
| 4,550,867 | A | * | 11/1985 | Bell et al. | 222/607 |
| 5,665,264 | A | * | 9/1997 | Sato et al. | 222/607 |

FOREIGN PATENT DOCUMENTS

JP 2008-006478 6/2006

* cited by examiner

*Primary Examiner* — Scott Kastler
*Assistant Examiner* — Michael Aboagye
(74) *Attorney, Agent, or Firm* — Martin Fleit; Paul D. Bianco; Fleit Gibbons Gutman Bongini & Bianco PL

(57) ABSTRACT

A continuous-casting-nozzle support apparatus capable of enhancing sealing performance between a continuous casting nozzle and an SN device. The continuous-casting-nozzle support apparatus comprises: a holding mechanism 40 disposed to extend from a stationary column 10 fixed onto a supporting surface, and adapted to be turnable in a horizontal direction and swingable or movable in an upward-downward direction; a lifting mechanism 70 provided on the side of a distal end of the holding mechanism 40; a supporting mechanism 80 provided on the side of a distal end of the lifting mechanism 70, and adapted to support a continuous casting nozzle 100; and a hooking device 90 provided in the lifting mechanism 70, and adapted to allow the lifting mechanism 70 to be hooked to a first engagement portion 111*a* formed on a sliding metal frame of a sliding nozzle device 110, wherein the lifting mechanism 70 is adapted to lift the continuous casting nozzle 100 through the supporting mechanism 80.

8 Claims, 8 Drawing Sheets

(a)

(b)

APPARATUS AND METHOD FOR SUPPORTING CONTINUOUS CASTING NOZZLE, SLIDING NOZZLE SYSTEM AND CONTINUOUS CASTING NOZZLE

TECHNICAL FIELD

The present invention relates to a support apparatus and method for supporting a long nozzle for discharging molten steel from a ladle to a tundish, an immersion nozzle for pouring molten nozzle from a tundish to a continuous casting mold or the like (hereinafter referred to collectively to "continuous casting nozzle"), while pressing the continuous casting nozzle against a sliding nozzle device (the "sliding nozzle" will hereinafter be abbreviated as SN) installed on a bottom of the ladle, the tundish or the like. The present invention also relates to a SN system comprising the support apparatus, and a continuous casting nozzle adapted to be suitably supported by the support apparatus.

BACKGROUND ART

In many cases, a continuous casting nozzle, such as a long nozzle or an immersion nozzle, is used with an SN device. For example, the long nozzle is often used under a condition that it is joined to a lower nozzle installed on a lower end of an SN device for use in discharge control of a ladle, or an intermediate nozzle joined to the lower nozzle. It is also joined to an SN plate installed to a lowermost metal frame, in some cases.

A joining section between the continuous casting nozzle and the SN device is structured such that they are joined together in close contact relation while being constantly pressed against each other in a nozzle axis direction (upward-downward direction). This is intended to shield a molten steel flow from ambient air to prevent oxidation, etc., of molten steel.

As a support apparatus for the continuous casting nozzle associated with the above pressing, the following Patent Document 1 disclosed one type adapted to press a continuous casting nozzle against a molten-steel discharge port by use of an arm as a "pry or lever" member.

Among continuous casting nozzles, a long nozzle to be attached on a lower side of a ladle is large in size and self-weight. Moreover, it is used in circumstances where an operator cannot directly perform an operation, for example, of attaching the long nozzle to a ladle at a position above a tundish. Therefore, the arm is used to support a self-weight of the long nozzle and allow an operator to remotely perform such an operation.

PRIOR ART DOCUMENT

Patent Document

[Patent Document 1] JP 2008-6478A

SUMMARY OF THE INVENTION

Problem to be Solved by the Invention

The support apparatus using the above arm is designed such that a continuous casting nozzle is kept in close contact with and integrated with an SN device only by a surface pressure applied to joined surfaces thereof. Thus, when an SN plate in contact with the continuous casting nozzle is slidingly moved, the continuous casting nozzle is displaced while being dragged by the SN plate. Therefore, in order to prevent the occurrence of a gap in a joined section therebetween during the displacement, it is necessary to apply a surface pressure to the joined surfaces at a value far greater than a surface pressure required just for leakage, oxidation, etc., of molten steel. Specifically, a surface pressure is loaded with a strong force beyond a surface pressure required for maintaining sealing performance, for example, by increasing a length of the arm to obtain a larger lever ratio, or by lifting the arm itself with a larger force. This causes a problem that the support apparatus is increased in size.

Further, the sliding movement of the SN device is along a straight line, whereas a resulting displacement of the arm of the support apparatus is along a circular arc, which means that a direction of the sliding movement of the SN device and a direction of the displacement of the arm are not aligned with each other. Thus, along with the sliding movement of the SN device, a force causing shearing between the SN device and the continuous casting nozzle will act on the joined surface of the SN device with the continuous casting nozzle in a rotation direction. Consequently, a plate brick or the like of the SN device is liable to be damaged, which often leads to deterioration in the close contact in the joined section.

Moreover, after completion of pouring of molten steel, solidified substances, such as solidified steel, remain on respective inner bores of the continuous casting nozzle and the SN device. Thus, it is often the case that the continuous casting nozzle cannot be separated from the SN device simply by releasing the surface pressure and without relying on an additional manual operation.

Therefore, in a support technique for supporting a continuous casting nozzle using an arm, it is an object of the present invention to provide an improved support technique capable of enhancing sealing performance between a continuous casting nozzle and an SN device.

Means for Solving the Problem

According to one aspect of the present invention, there is provided a continuous-casting-nozzle support apparatus for supporting a continuous casting nozzle while pressing the continuous casting nozzle against a sliding nozzle device. The continuous-casting-nozzle support apparatus comprises: a holding mechanism disposed to extend from a stationary column fixed onto a supporting surface, and adapted to be turnable in a horizontal direction and swingable or movable in an upward-downward direction; a lifting mechanism provided on the side of a distal end of the holding mechanism; a supporting mechanism provided on the side of a distal end of the lifting mechanism, and adapted to support the continuous casting nozzle; and a hooking device provided in the lifting mechanism, and adapted to allow the lifting mechanism to be hooked to a first engagement portion formed on a sliding metal frame of the sliding nozzle device, wherein the lifting mechanism is adapted to lift the continuous casting nozzle through the supporting mechanism.

In the continuous-casting-nozzle support apparatus of the present invention, based on the hooking device, the continuous casting nozzle can be integrated with the SN device with a surface pressure less than ever before to facilitate a reduction in size of the apparatus.

In the present invention, the holding mechanism is provided with the supporting mechanism on the side of the distal end thereof to serve as a means to hold a continuous casting nozzle attached to the supporting mechanism, by an arm extending from the stationary column and others. Specifically, the holding mechanism may comprise a joint 20, a rotary shaft 30, a support arm 40, an actuator 50, a horizontal-turn pivot shaft (pivot shaft for horizontal turn) 60, and a frame 74 (see FIG. 1).

Preferably, in the continuous-casting-nozzle support apparatus of the present invention, the supporting mechanism includes a second engagement portion engageable with a protrusion provided on the continuous casting nozzle, wherein the lifting mechanism is adapted to be capable of lowering the continuous casting nozzle downwardly through the supporting mechanism. This makes it possible to easily separate the continuous casting nozzle from the SN device. More preferably, the second engagement portion is adapted to be engaged with a plurality of protrusions provided on the continuous casting nozzle from above the respective protrusions. In this case, during the operation of lowering the continuous casting nozzle downwardly by the lifting mechanism, a lowering force by the lifting mechanism can be efficiently applied to the continuous casting nozzle to more easily separate the continuous casting nozzle from the SN device.

Preferably, in the above continuous-casting-nozzle support apparatus, the lifting mechanism includes an arm adapted to be moved forwardly and backwardly by a driving device, and a bell crank having one end coupled to the arm and the other end coupled to the supporting mechanism, wherein the supporting mechanism is adapted, according to the forward and backward movements of the arm, to be moved upwardly and downwardly through the bell crank to lift and lower the continuous casting nozzle. More preferably, the lifting mechanism further includes a biasing device for constantly biasing the arm in a direction causing the supporting mechanism to be moved upwardly.

Alternatively, instead of the arm and the bell crank, the lifting mechanism may include a rack adapted to be moved forwardly and backwardly by a driving device, and a feed screw having one end with a pinion meshed with the rack and the other end screwed into the supporting mechanism. In this case, the supporting mechanism is adapted, according to the forward and backward movements of the rack, to be moved upwardly and downwardly through the feed screw to lift and lower the continuous casting nozzle.

Preferably, in the continuous-casting-nozzle support apparatus of the present invention, the holding mechanism includes: a rotary shaft coupled to the stationary column turnably about the stationary column; an extendable and retractable support arm coupled to the rotary shaft turnably in a horizontal direction and swingably in an upward-downward direction about the rotary shaft; and an actuator disposed between the rotary shaft and the support arm and adapted to swingingly move the support arm in the upward-downward direction, wherein the lifting mechanism is coupled to the support arm turnably in a horizontal direction, and the supporting mechanism is coupled to the lifting mechanism. In this case, based on a combination of horizontal turns about three axes of the stationary column, the rotary shaft and the horizontal-turn pivot shaft attached to the support arm, the lifting mechanism and the supporting mechanism can be displaced along a substantially straight line instead of a circular arc, so that a direction of a displacement of the continuous casting nozzle supported by the supporting mechanism can be substantially aligned with a direction of a sliding movement of the SN device.

According to another aspect of the present invention, there is provided a sliding nozzle system which comprises the above continuous-casting-nozzle support apparatus, and a sliding nozzle device having a sliding metal frame formed with the first engagement portion hookable by the hooking device of the continuous-casting-nozzle support apparatus.

According to yet another aspect of the present invention, there is provided a continuous casting nozzle which comprises a protrusion engageable with the second engagement portion of the above continuous-casting-nozzle support apparatus.

According to still another aspect of the present invention, there is provided a method for supporting a continuous casting nozzle while pressing the continuous casting nozzle against a sliding nozzle device. The method comprises the steps of: supporting the continuous casting nozzle by a supporting mechanism included in a lifting mechanism attached to a holding mechanism extending from a stationary column fixed onto a supporting surface; hooking the lifting mechanism to a first engagement portion formed on a sliding metal frame of the sliding nozzle device, through a hooking device; and lifting the continuous casting nozzle upwardly by the lifting mechanism through the supporting mechanism.

In an operation of separating the continuous casting nozzle from the sliding nozzle device, the above method may comprise the steps of: engaging a second engagement portion of the supporting mechanism with a protrusion provided on the continuous casting nozzle; and lowering the continuous casting nozzle downwardly by the lifting mechanism through the supporting mechanism.

Effect of the Invention

The present invention makes it possible to integrate a continuous casting nozzle with an SN device with a surface pressure less than ever before.

BRIEF DESCRIPTION OF THE DRAWINGS

FIG. 5(*b*) is an explanatory diagram showing one example of a structure of a hook portion of the hooking device adapted to be hooked with the engagement portion illustrated in FIG. 5(*a*).

FIG. 6(*b*) is a fragmentary sectional view of the lifting mechanism in FIG. 6(*a*).

BEST MODE FOR CARRYING OUT THE INVENTION

With reference to the accompanying drawings, a continuous-casting-nozzle support apparatus according to an embodiment of the present invention and a sliding nozzle system having the support apparatus will now be specifically described. The following description is of the best-contemplated mode of carrying out of the invention. This description is made for the purpose of illustrating the general principles of the invention and should not be taken in a limiting sense.

Figure 1:
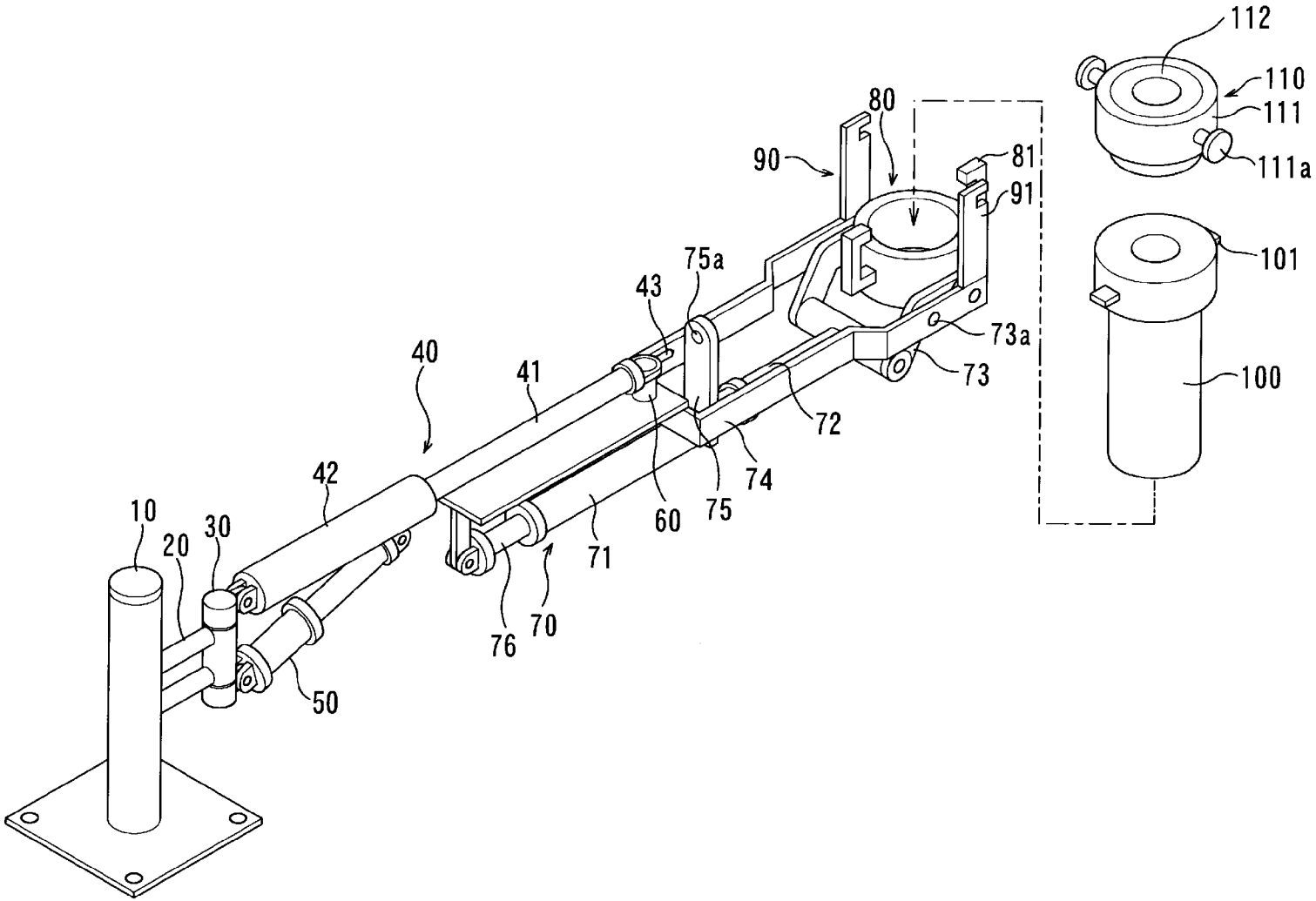
FIG. 1 is a fragmentary perspective view showing an SN system having a continuous-casting-nozzle support apparatus according to one embodiment of the present invention according to the present invention.

FIG. 1 is a fragmentary perspective view showing an SN system having a continuous-casting-nozzle support apparatus according to a first embodiment of the present invention. The continuous-casting-nozzle support apparatus in the SN system illustrated in FIG. 1 comprises: a stationary column 10 fixed onto a supporting surface (for example, a carriage such as a tundish car having a molten metal vessel (e.g., a tundish) installed therein, or a floor surface of a building having continuous casting equipment installed therein) for supporting the support apparatus; a rotary shaft 30 coupled to the stationary column 10 turnably about the stationary column 10 through a joint 20; and a support arm 40 coupled to the rotary shaft 30 turnably in a horizontal direction and swingably in an upward-downward direction, about the rotary shaft 30. Further, an actuator 50 composed of an air cylinder is disposed between the support arm 40 and the rotary shaft 30, and adapted to swingingly move the support arm 40 in the upward-downward direction. The actuator 50 is also coupled to the rotary shaft 30 turnably in a horizontal direction about the rotary shaft 30, so that it can be horizontally turned in synchronization with the support arm 40.

The support arm 40 composed of an air cylinder is adapted to be extendable and retractable according to forward and backward movements of a cylinder rod 41 disposed on the side of a distal end thereof. The support arm 40 is not limited to the air cylinder but any other extendable/retractable mechanism, such as a hydraulic cylinder, may be used. The cylinder rod 41 is attached to a cylinder body 42 rotatably about a longitudinal axis thereof. For example, the cylinder rod 41 may be attached to the cylinder body 42 through a bearing device or the like to achieve the rotation about the longitudinal axis. A lifting mechanism 70 is coupled to a distal end of the cylinder rod 41 through a horizontal-turn pivot shaft (pivot shaft for horizontal turn) 60 composed of a spherical slide bearing. Thus, the lifting mechanism 70 can be moved about the horizontal-turn pivot shaft 60 in all directions to a certain extent. Alternatively, the lifting mechanism 70 may be designed such that the horizontal turn thereof is achieved by means of the horizontal-turn pivot shaft 60, and an upward-downward movement thereof is achieved by means of the actuator 50 of the support arm 40 or the like.

The lifting mechanism 70 includes an arm 72 adapted to be moved forwardly and backwardly by an air cylinder 71, and a pair of L-shaped bell cranks 73. Each of the bell cranks 73 has one end (first end) pivotally supported by a distal end of the arm 72 and the other end (second end) supporting a ring-shaped supporting mechanism 80 adapted to support a long nozzle 100 (continuous casting nozzle) from therebelow. The long nozzle 100 has two protrusions 101 symmetrically provided on a lateral surface of a metal casing covering an outer surface thereof, and the supporting mechanism 80 is provided with an engagement portion 81 adapted to be engaged with the protrusions 101 from thereabove.

The air cylinder 71 of the lifting mechanism 70 is supported by a frame 74 through an end of a cylinder rod 76 thereof. This frame 74 is attached to the distal end of the cylinder rod 41 through the horizontal-turn pivot shaft 60. The air cylinder 71 has a guide member 75 protruding upwardly. The guide member 75 has an engagement hole 75*a* engageable with an engagement pin 43 provided at the distal end of the cylinder rod 41 of the support arm 40. Each of the bell cranks 73 has an intermediate portion pivotally supported by a pivot shaft 73*a* fixed to the frame 74, so that the bell cranks 73 can be rotated about the pivot shafts 73*a*.

In addition to the above structure, the continuous-casting-nozzle support apparatus according to the first embodiment comprises a hooking device adapted to be hooked to an SN device 110. In the first embodiment illustrated in FIG. 1, the hooking device 90 is fixed to the frame 74 of the lifting mechanism 70. The SN device 110 has an engagement portion 111*a* provided on a lower nozzle sleeve 111 of a sliding metal frame thereof, and the hooking device 90 has a groove-shaped hook portion 91 provided at an upper end thereof and adapted to be hooked to the engagement portion 111*a*. In other words, the lifting mechanism 70 is adapted to be hooked to the engagement portion 111*a* of the SN device 110 through the hooking device 90.

With reference to FIGS. 2A to 2H, an operation of the continuous-casting-nozzle support apparatus according to the first embodiment illustrated in FIG. 1 will be described below.

Figure 2A:
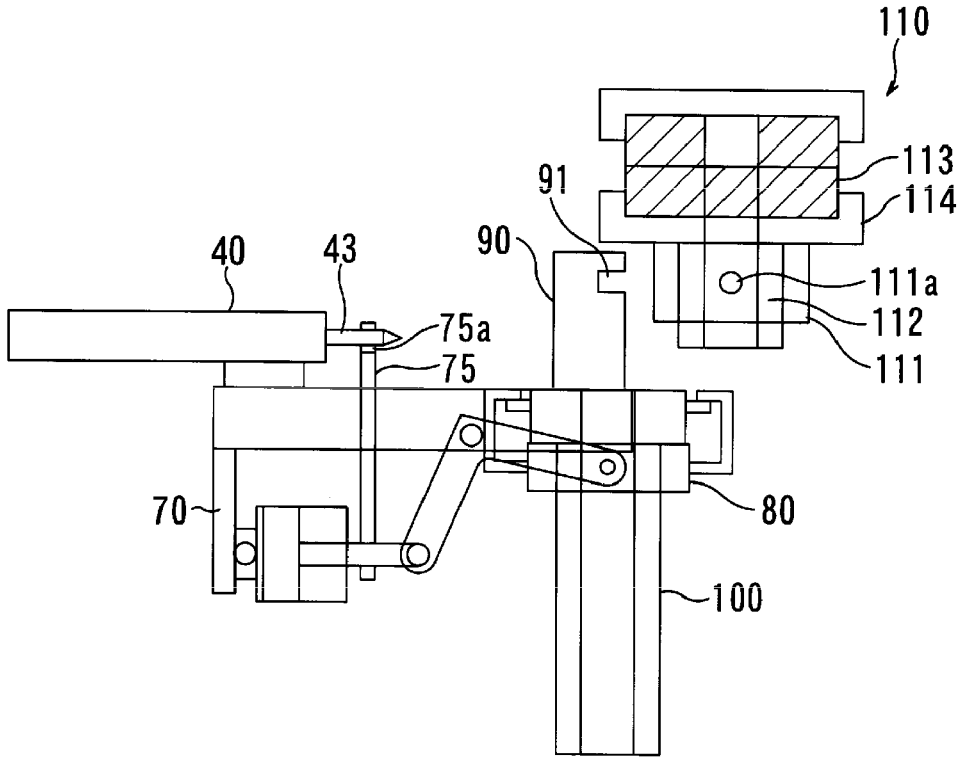
FIG. 2A is an explanatory diagram showing an operation of the continuous-casting-nozzle support apparatus.

As shown in FIG. 2A, after supporting the long nozzle 100 by the supporting mechanism 80, the supporting mechanism 80 is positioned such that a position of the hook portion 91 of the hooking device 90 is aligned with a position of the engagement portion 111*a* of the lower nozzle sleeve 111 of the sliding metal frame 114. This positioning is performed based on a combination of a turning movement of the rotary shaft 30 about the stationary column 10, a horizontal turning movement of the support arm 40 about the rotary shaft 40, and an upward-downward swing movement of the support arm 40 by the actuator 50. In this step, the turning movement and the horizontal turning movement are performed manually or by mechanical driving using a motor or the like.

In the positioned state, as shown in FIG. 2A, the engagement pin 43 provided on the support arm 40 is engaged with the engagement hole 75*a* provided in the guide member 75 of the lifting mechanism 70, so that the horizontal turning movement and the upward-downward swing movement of the lifting mechanism 70 are restrained to prevent the supporting mechanism 80 coupled to the lifting mechanism 70 and the long nozzle 100 from being unnecessarily turned in a horizontal direction.

Figure 2B:
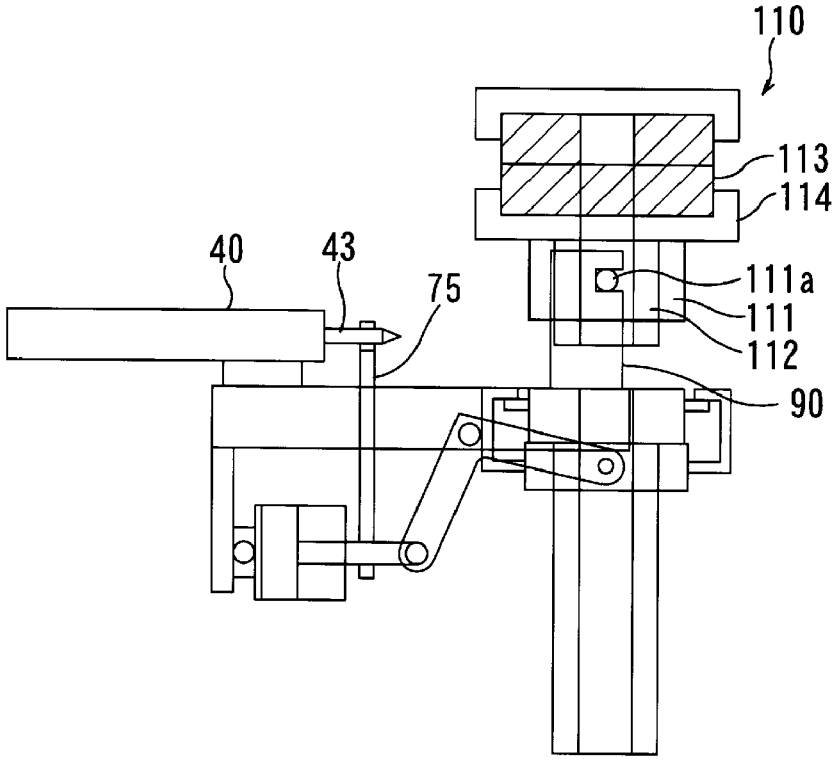
FIG. 2B is an explanatory diagram showing the operation of the continuous-casting-nozzle support apparatus.

Then, as shown in FIG. 2B, the support arm 40 is extended, so that the hooking device 90 is moved forwardly, and the hook portion 91 of the hooking device 90 is hooked to the engagement portion 111*a* of the lower nozzle sleeve 111.

Figure 2C:
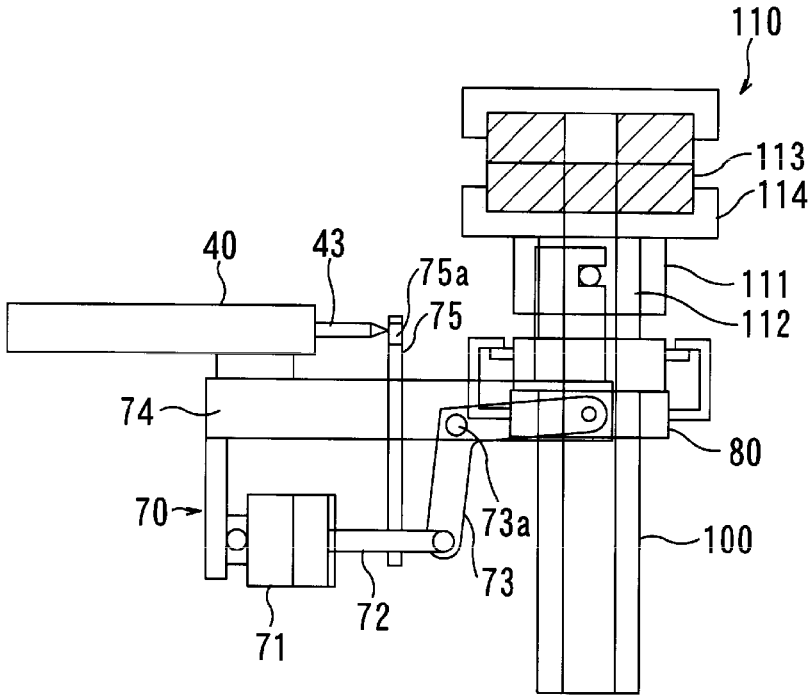
FIG. 2C is an explanatory diagram showing the operation of the continuous-casting-nozzle support apparatus.

Subsequently, as shown in FIG. 2C, the air cylinder 71 of the lifting mechanism 70 is activated to move the arm 72 forwardly. Along with the forward movement of the arm 72, the bell cranks 73 are rotated about the pivot shafts 73*a* fixed to the frame 74 of the lifting mechanism 70, so that the second ends of the bell cranks 73 are moved upwardly. Thus, the supporting mechanism 80 supporting the long nozzle 100 is moved upwardly, so that the long nozzle 100 is pressed against a lower nozzle 112 while applying a surface pressure thereto. Concurrently, the engagement between the engagement hole 75*a* and the engagement pin 43 of the support arm 40 is released along with the forward movement of the arm 72. Thus, the lifting mechanism 70 becomes movable relative to the support arm 40 and about the horizontal-turn pivot shaft 60 in all directions to a certain extent.

Figure 2D:
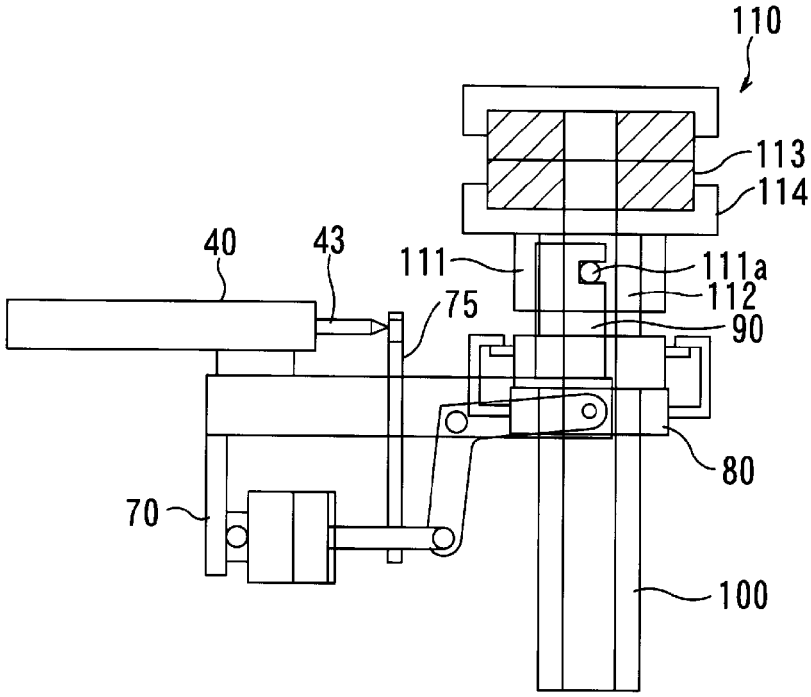
FIG. 2D is an explanatory diagram showing the operation of the continuous-casting-nozzle support apparatus.

After applying a surface pressure, as shown in FIG. 2D, a plate brick 113 of the SN device 110 is slidingly moved to set the SN device 110 to an open state so as to start continuous casting. In this case, the plate brick 113 is slidingly moved in a direction perpendicular to the drawing sheet of FIG. 2D. In the first embodiment, the hooking device 90 of the support apparatus is hooked to the engagement portion 111*a* provided on the lower nozzle sleeve 111 of the sliding metal frame 114 of the SN device, as mentioned above, so that the support apparatus and the SN device are integrated together through the sliding metal frame. Thus, during the operation of slidingly moving the plate brick 113, no sliding force occurs between the lower nozzle 112 and the long nozzle 100. In addition, based on a combination of horizontal turns about three axes of the stationary column 10, the rotary shaft 30 and the horizontal-turn pivot shaft 60, the lifting mechanism 70 and the supporting mechanism 80 can be displaced along a substantially straight line instead of a circular arc, so that a direction of a displacement of the long nozzle supported by the supporting mechanism 80 can be substantially aligned with the direction of the sliding movement of the plate brick 113. Thus, during the sliding movement of the plate brick 113, no sliding force occurs on a joined surface of the plate brick 113 with the lower nozzle 112 and the long nozzle 100, which makes it possible to prevent damage of the plate brick. Further, the support apparatus and the SN device are integrated together through the sliding metal frame, as mentioned above, so that a surface pressure may be applied between the lower nozzle 112 and the long nozzle 100 at a minimum level required for preventing leakage and oxidation of molten steel. Thus, it becomes possible to facilitate a reduction in size of a mechanism for applying a surface pressure.

When the continuous casting is terminated, the plate brick 113 is slidingly moved in a reverse direction to set the SN device 110 to a closed state.

Figure 2E:
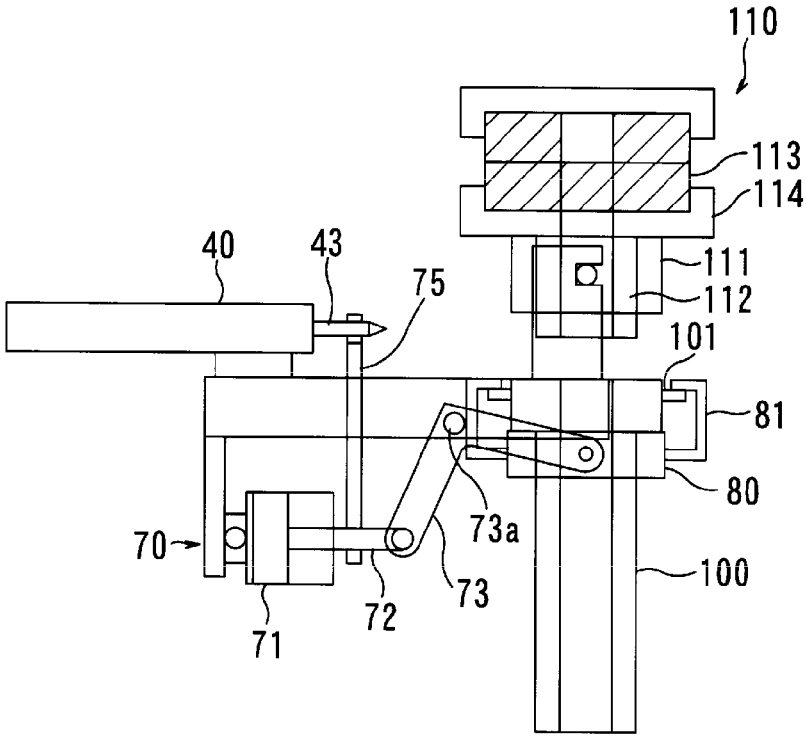
FIG. 2E is an explanatory diagram showing the operation of the continuous-casting-nozzle support apparatus.

Then, as shown in FIG. 2E, the air cylinder 71 of the lifting mechanism 70 is activated to move the arm 72 backwardly. Along with the backward movement of the arm 72, the bell cranks 73 are rotated about the pivot shafts 73*a*, so that the second ends of the bell cranks 73 are moved downwardly, and thereby the supporting mechanism 80 supporting the long nozzle 100 is moved downwardly. During this movement, the engagement portion 81 provided on the supporting mechanism 80 is engaged with the protrusions 101 provided on the long nozzle 100, so that the long nozzle 100 is lowered according to the downward movement of the supporting mechanism 80. This makes it possible to easily separate the long nozzle 100 from the lower nozzle 112.

Figure 2F:
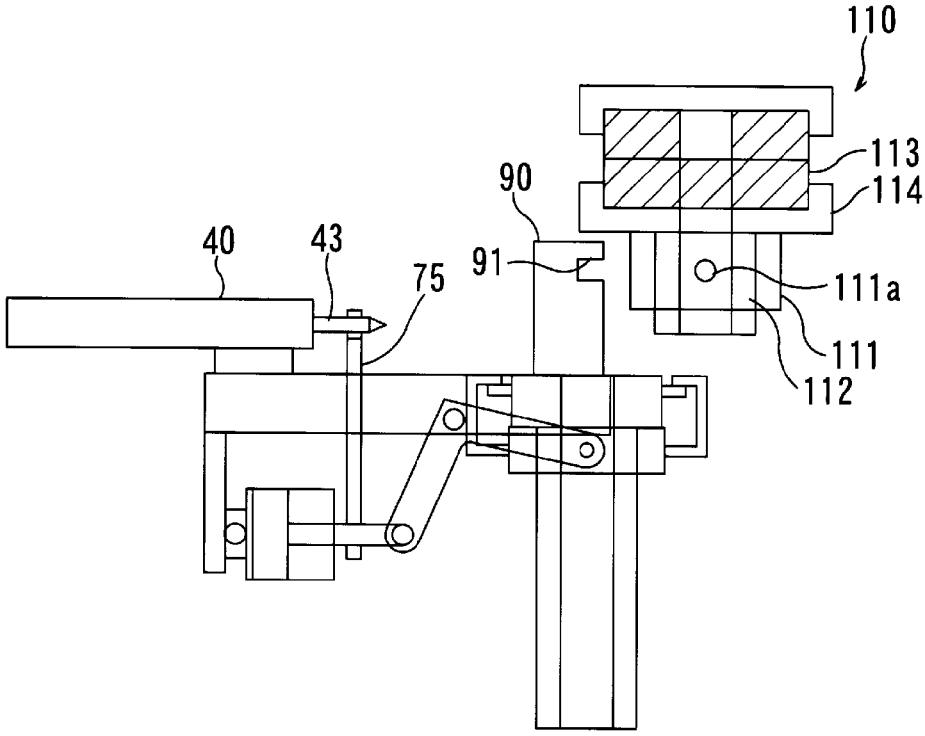
FIG. 2F is an explanatory diagram showing the operation of the continuous-casting-nozzle support apparatus.

After separating the long nozzle 100 from the lower nozzle 112, the support arm 40 is retracted, so that the hooking device 90 is moved backwardly, and the hook engagement between the hook portion 91 of the hooking device 90 and the engagement portion 111*a* of the lower nozzle sleeve 111 is released, as shown in FIG. 2F.

Figure 3:
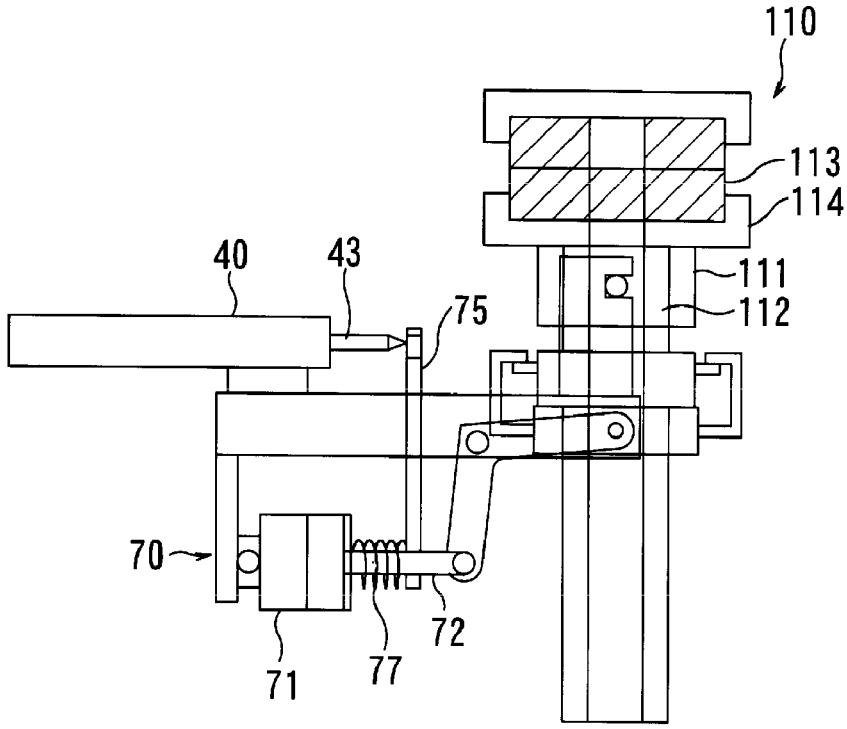
FIGS. 3A and 3B are explanatory diagrams showing two examples of a structure of a biasing device.
Figure 3:
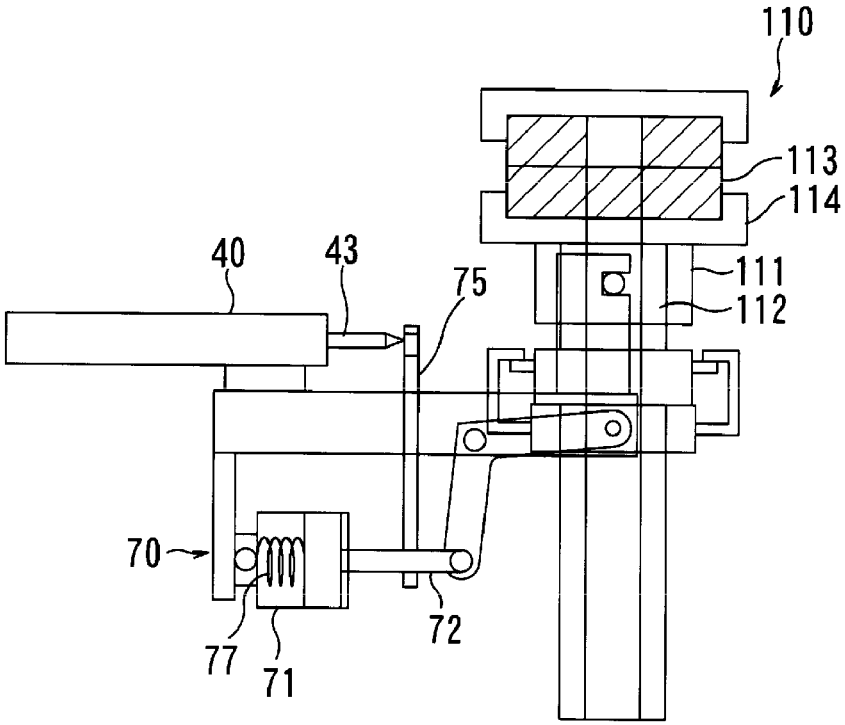

In the first embodiment, the arm 72 is moved forwardly by the cylinder 71 of the lifting mechanism 70 to press the long nozzle 100 against the lower nozzle 112 while applying a surface pressure thereto. In order to make it possible to apply a certain level of surface pressure even if the cylinder 71 breaks down, it is preferable to provide a biasing device for constantly biasing the arm 71 in a forward direction. For example, as shown in FIG. 3(*a*), a spring 77 may be disposed between an outer casing of the cylinder 71 and the guide member 75 provided on the arm 75. Such a spring 77 may be disposed within the cylinder 71 as shown in FIG. 3(*b*).

Figure 4:
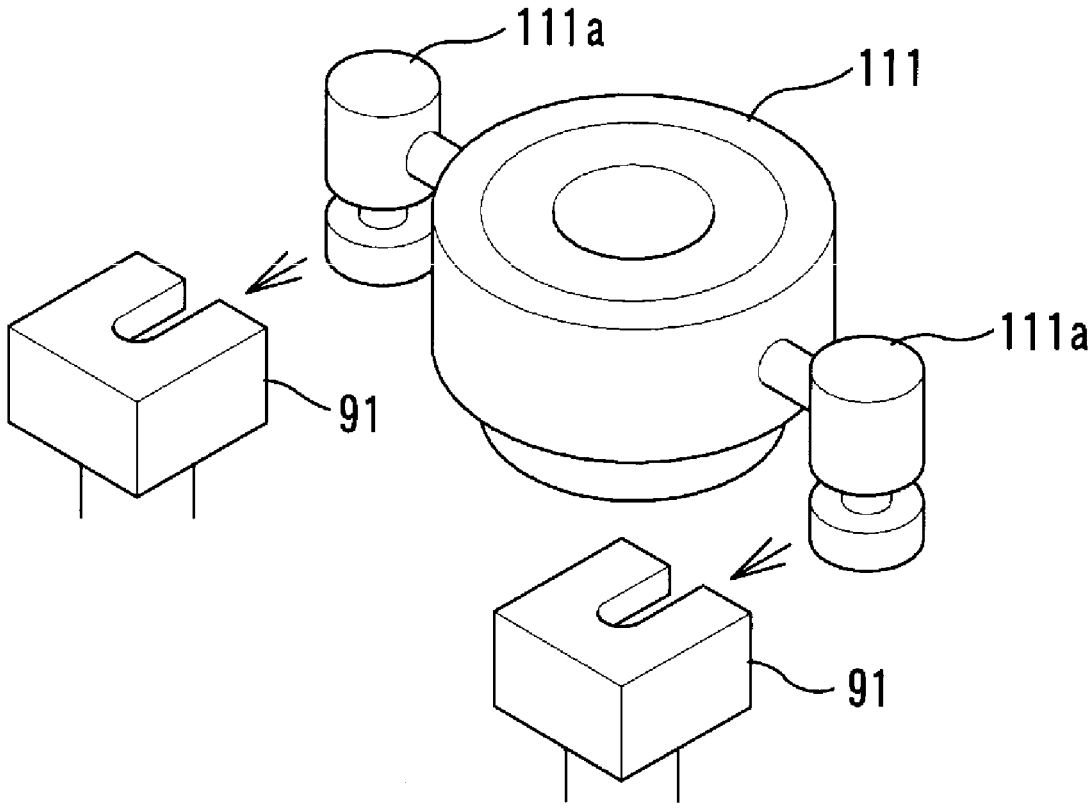
FIG. 4 is an explanatory diagram showing one example of a structure of a hooking device.

In the first embodiment, in order to ensure the hook engagement between the hooking device 90 and the SN device, it is preferable that the hook portion 91 of the hooking device 90 is formed in a groove-like shape to provide a pair of hooking surfaces on upper and lower sides thereof, as shown in FIG. 1 and FIGS. 2A to 2F. For example, the hook portion 91 of the hooking device 90 and the engagement portion 111*a* of the lower nozzle sleeve 111 may be formed as shown in FIG. 4 to allow the hook portion 91 to be hooked to the engagement portion 111*a* through upper and lower surfaces thereof.

Figure 5:
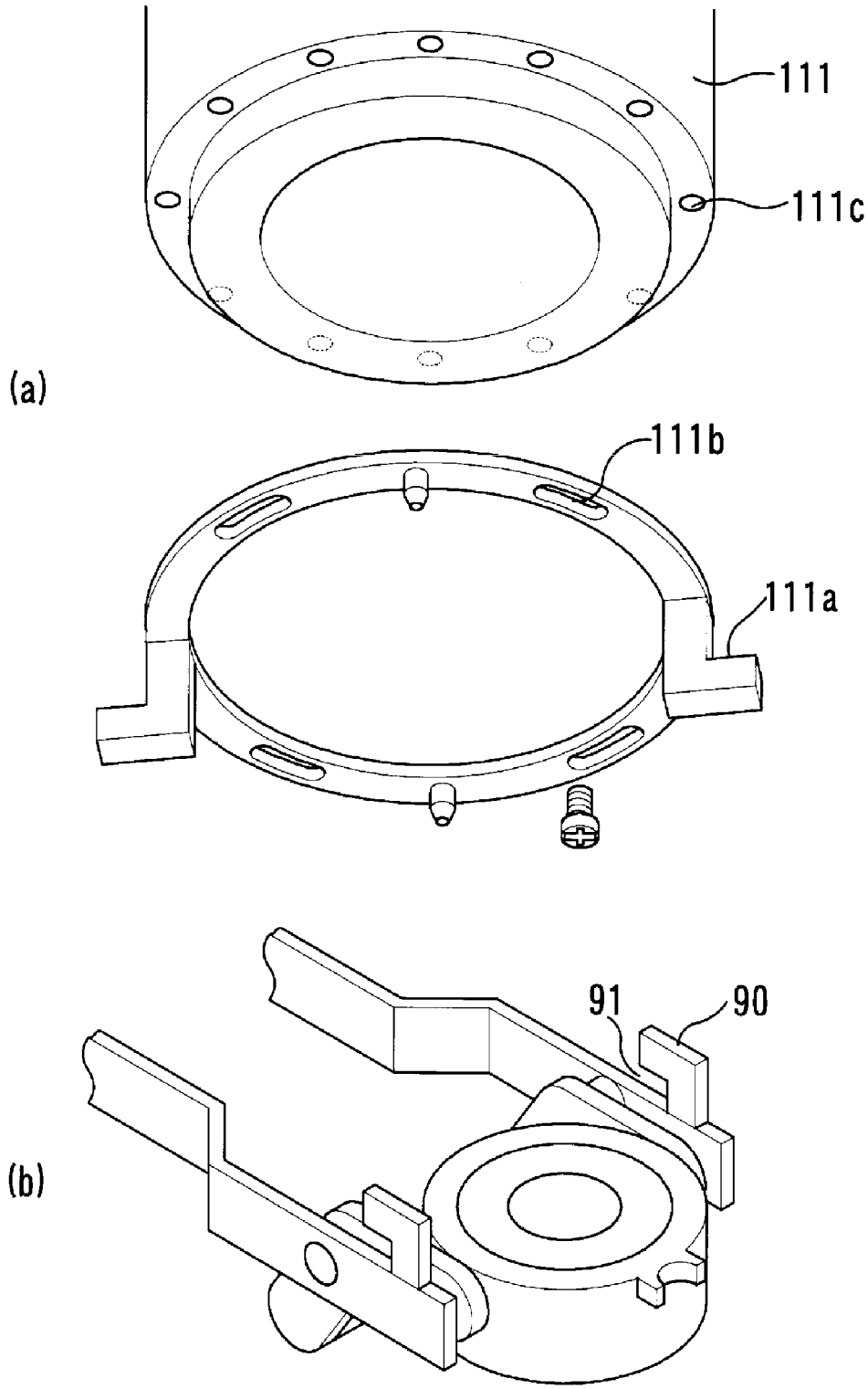
FIG. 5(*a*) is an explanatory diagram showing one example of a structure of an engagement portion to be hooked by the hooking device.

In the first embodiment, the SN device may be designed to allow a position of the engagement portion 111*a* of the lower nozzle sleeve 111 to be adjusted depending on a positional relationship between the hooking device 90 and the engagement portion 111*a*. For this purpose, for example, as shown in FIG. 5(*a*), a metal frame provided with an engagement portion 111*a* is formed as a member which is separated from the lower nozzle sleeve 111 and adapted to be fixed to the lower nozzle sleeve 111 at any circumferential position. More specifically, a bolt-insertion elongate hole 111*b* is formed in the metal frame provided with the engagement portion 111*a*, and a large number of bolt-holes 111*c* are formed in the lower nozzle sleeve 111 along a circumferential direction thereof at even intervals. Then, the metal frame is fixed to the lower nozzle sleeve 111 by screwing a bolt into one of the bolt-holes 111*c* through the elongate hole 111*b*.

FIG. 5(*b*) shows one example of a structure of the hook portion 91 of the hooking device 90 to be hooked to the engagement portion 111*a* illustrated in FIG. 5(*a*). In this structure, after the engagement portion 111*a* is put in a cutout of the hook portion 91, the hook portion 91 can also be hooked to the engagement portion 111*a* through upper and lower hooking surfaces thereof.

In FIG. 1, the engagement portion 111*a* is provided on the lower nozzle sleeve 111 of the sliding metal frame. Alternatively, the engagement portion may be provided on the sliding metal frame itself, as described later with reference to FIGS. 6(*a*) and 6(*b*). Alternatively, the engagement portion may be provided on a lower nozzle metal frame of the sliding metal frame. The point is to provide the engagement portion to the sliding metal frame. As used herein, the term "sliding metal frame" collectively means a sliding metal frame itself, a lower nozzle sleeve or lower nozzle metal frame fixed to the sliding metal frame, and any other metal frame.

Figure 6:
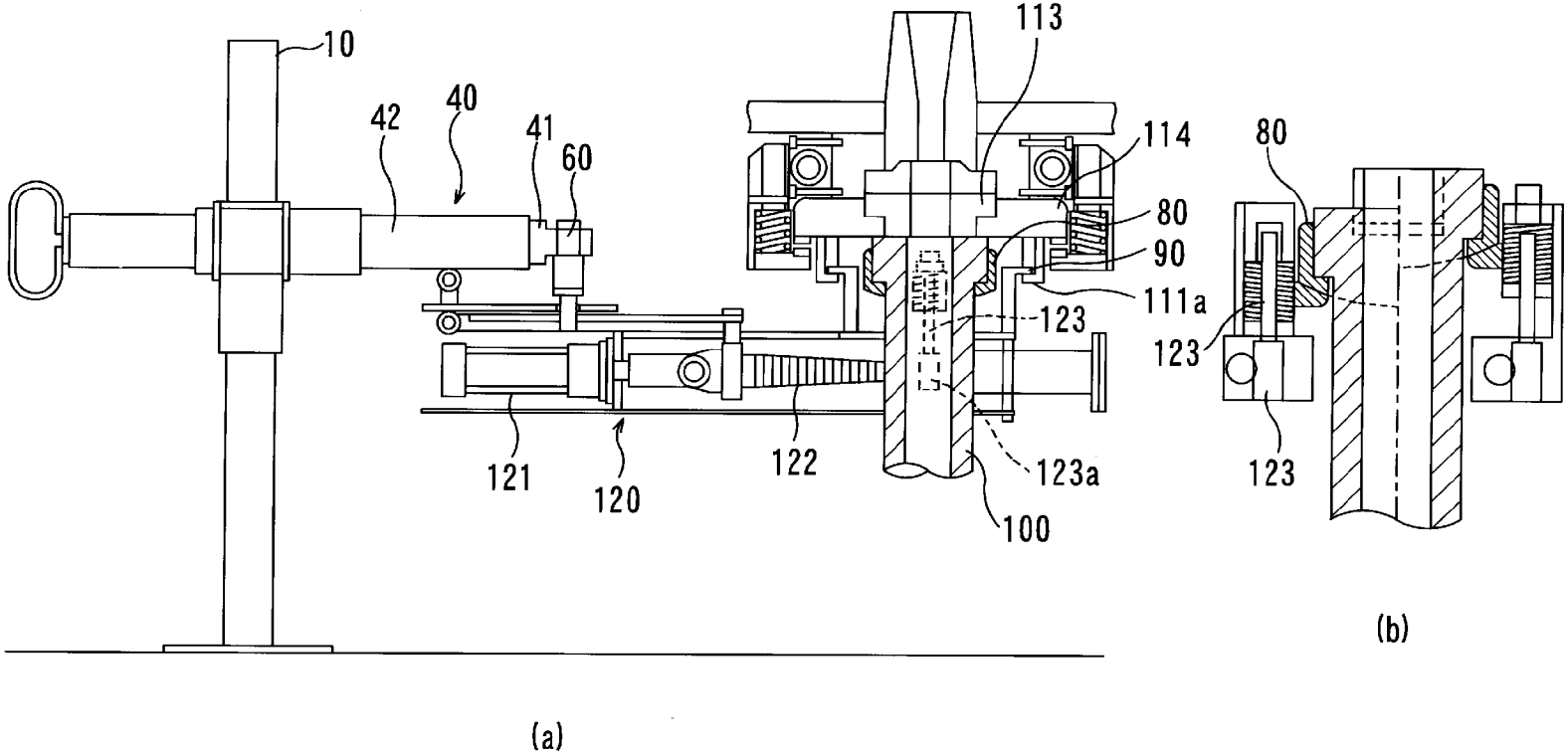
FIG. 6(*a*) is a front view showing a lifting mechanism in a continuous-casting-nozzle support apparatus according to another embodiment of the present invention.

FIG. 6(*a*) is a front view showing a lifting mechanism in a continuous-casting-nozzle support apparatus according to a second embodiment of the present invention. FIG. 6(*b*) is a sectional view of the lifting mechanism in FIG. 6(*a*), taken along a plane including an axis of an inner bore of a continuous casting nozzle (long nozzle) 100 and extending parallel to a vertical surface of a rack 122. In FIGS. 6(*a*) and 6(*b*), an element or component having the same function as that of an element or component illustrated in FIG. 1 is defined by a common reference numeral or code, and its detailed description will be omitted.

As shown in FIGS. 6(*a*) and 6(*b*), the continuous-casting-nozzle support apparatus according to the second embodiment comprises: a stationary column 10; a support arm 40 provided on the stationary column 10 movably in an upward-downward direction along the stationary column 10 and turnably in a horizontal direction about the stationary column 10, and adapted to be extendable with respect to the stationary column 10 in a forward direction (in a direction toward a continuous casting nozzle); and a lifting mechanism 120 provided on the side of a distal end of the support arm 40.

The lifting mechanism 120 comprises a rack 122 adapted to be moved forwardly and backwardly by a hydraulic cylinder 121 serving as a driving device, and a feed screw 123 having one end with a pinion 123*a* meshed with the rack 122 and the other end screwed into a supporting mechanism 80.

According to the forward and backward movements of the rack 122, the feed screw 123 is rotated, so that the supporting mechanism 80 is moved upwardly and downwardly to lift and lower a continuous casting nozzle 100.

In the lifting mechanism 120 based on the above rack and pinion mechanism, even if the hydraulic cylinder 121 serving as the driving device breaks down, the rack 122 and the pinion 123*a* are kept still at their positions to maintain a surface pressure. Thus, there is no need to provide a biasing device (spring 76) as in the lifting mechanism 70 based on the bell crank mechanism. In addition, the supporting mechanism 80 can be moved accurately vertically by the rack and pinion mechanism and the feed screw 123, which makes it possible to more uniformly apply a surface pressure, as compared with the afore-mentioned lifting mechanism 70 based on the bell crank mechanism.

In the above continuous-casting-nozzle support apparatus according to the second embodiment, after supporting the long nozzle 100 by the supporting mechanism 80, the supporting mechanism 80 is positioned such that a position of a hook portion 91 of a hooking device 90 is aligned with a position of an engagement portion 111*a*. This positioning is performed based on a combination of a horizontal turning movement of the support arm 40 about the stationary column 10, an upward-downward movement of the support arm 40 along the stationary column 10, and a forward-backward movement of the hooking device 90 according to the extension and retraction of the support arm 40. After the positioning, the hook portion of the hooking device 90 is hooked to the engagement portion 111*a*.

Then, the rack 122 is moved forwardly to rotate the feed screw 123, so that the supporting mechanism 80 is moved upwardly to lift the continuous casting nozzle 100. Thus, according to the upward movement of the supporting mechanism 80 supporting the long nozzle 100, the long nozzle 100 is pressed against a lower nozzle 112 while applying a surface pressure thereto.

After applying a surface pressure, a plate brick of an SN device 110 is slidingly moved to set the SN device 110 to an open state so as to start continuous casting. During the operation of slidingly moving the SN device, the lifting mechanism 120 and the supporting mechanism 80 can be displaced along a substantially straight line, based on a combination of horizontal turns about two axes of the stationary column 10 and a horizontal-turn pivot shaft 60, and the extension/retraction of the arm 41.

In an operation of detaching the long nozzle 100, the rack 122 is moved backwardly to rotate the feed screw 123, so that the supporting mechanism 80 is moved downwardly.

In FIG. 6, the engagement portion 111*a* is formed on a sliding metal frame 114. Alternatively, a lower nozzle sleeve having the engagement portion may be provided to the sliding metal frame, as described in connection with FIG. 1.

The support arm 40 may have any structure where a forward end thereof is extendable and retractable with respect to the stationary column 10. For example, the support arm 40 may be designed such that the entire arm is moved forwardly and rearwardly with respect to the stationary column 10 so as to adjust a length of the forward end.

Although the first and second embodiments have been described based on a long nozzle to be installed on a bottom side of a ladle, the present invention is usable in any other suitable type of continuous-casting-nozzle support apparatus having a mechanism for pressing a continuous casting nozzle, such as an immersion nozzle to be installed on a bottom side of a tundish, against an SN device while holding the nozzle by an arm.

As above, in the continuous-casting-nozzle support apparatuses according to the above embodiments, sealing performance can be ensured with a surface pressure less than ever before to facilitate a reduction in size of the apparatus. In addition, the reduction in surface pressure makes it possible to reduce damage of a brick constituting a continuous casting nozzle and an SN device.

Further, the lifting mechanism and supporting mechanism are supported through two or three horizontal-turn pivot shafts. Thus, it becomes possible to substantially align a direction of a displacement of the continuous casting nozzle with a direction of a sliding movement of the SN device to prevent damage of the brick and deterioration in close contact in a joined section, which would otherwise be caused by the sliding movement of the SN device.

Further, a second engagement portion is provided on the supporting mechanism. Thus, under a condition that an engagement portion provided on the continuous casting nozzle is engaged with the second engagement portion, the supporting mechanism can be moved downwardly by the lifting mechanism to lower the continuous casting nozzle downwardly, so that the continuous casting nozzle can be easily separated from the SN device.

Further, the hooking device can be selectively hooked to and unhooked from a first engagement portion of the SN device according to a movement of the support arm, and the continuous casting nozzle can be selectively lifted and lowered by the lifting mechanism. Thus, even under a condition that the continuous-casting-nozzle support apparatus is coupled to and integrated with the SN device, the above operations can be controlled at a position distant from a molten metal vessel.

EXPLANATION OF CODES

10: stationary column
20: joint
30: rotary shaft
40: support arm
41: cylinder rod
42: cylinder body
43: engagement pin
50: actuator
60: horizontal-turn pivot shaft
70: lifting mechanism
71: air cylinder (driving device)
72: arm
73: bell crank
73*a*: pivot shaft
74: frame
75: guide member
75*a*: engagement hole
76: cylinder rod
77: spring (biasing device)
80: supporting mechanism
81: engagement portion (second engagement portion)
90: hooking device
91: hook portion
100: long nozzle (continuous casting nozzle)
101: protrusion
110: SN device
111: lower nozzle sleeve
111*a*: engagement portion (first engagement portion)
111*b*: elongate hole

111*c*: bolt-hole
112: lower nozzle
113: plate brick
114: sliding metal frame
120: lifting mechanism
121: hydraulic cylinder (driving device)
122: rack
123: feed screw
123*a*: rack

The invention claimed is:

1. A continuous-casting-nozzle support apparatus for supporting a continuous casting nozzle while pressing the continuous casting nozzle against a sliding nozzle device, comprising:

a holding mechanism disposed to extend from a stationary column fixed onto a supporting surface, and adapted to be turnable in a horizontal direction and swingable or movable in an upward-downward direction;

a lifting mechanism coupled to the holding mechanism;

a supporting mechanism coupled to the lifting mechanism, and adapted to support the continuous casting nozzle; and a hooking device provided in the lifting mechanism, and adapted to allow the lifting mechanism to be hooked to a first engagement portion formed on a sliding metal frame of the sliding nozzle device, wherein the supporting mechanism includes a second engagement portion engageable with a protrusion provided on the continuous casting nozzle, and wherein the lifting mechanism is adapted to be capable of lower the continuous casting nozzle downwardly through the supporting mechanism, wherein the lifting mechanism is adapted to lift the continuous casting nozzle through the supporting mechanism and includes:

an arm adapted to be moved forwardly and backwardly by a driving device; and a bell crank having one end coupled to the arm and the other end coupled to the supporting mechanism, and wherein the supporting mechanism is adapted, according to the forward and backward movements of the arm, to be moved upwardly and downwardly through the bell crank to lift and lower the continuous casting nozzle.

2. A continuous-casting-nozzle support apparatus for supporting a continuous casting nozzle while pressing the continuous casting nozzle against a sliding nozzle device, comprising:

a holding mechanism disposed to extend from a stationary column fixed onto a supporting surface, and adapted to be turnable in a horizontal direction and swingable or movable in an upward-downward direction;

a lifting mechanism coupled to the holding mechanism;

a supporting mechanism coupled to the lifting mechanism, and adapted to support the continuous casting nozzle; and a hooking device provided in the lifting mechanism, and adapted to allow the lifting mechanism to be hooked to a first engagement portion formed on a sliding metal frame of the sliding nozzle device, wherein the supporting mechanism includes a second engagement portion engageable with a protrusion provided on the continuous casting nozzle, and wherein the lifting mechanism is adapted to be capable of lower the continuous casting nozzle downwardly through the supporting mechanism, wherein the lifting mechanism is adapted to lift the continuous casting nozzle through the supporting mechanism and includes:

a rack adapted to be moved forwardly and backwardly by a driving device; and a feed screw having one end with a pinion meshed with the rack and the other end screwed into the supporting mechanism, and wherein the supporting mechanism is adapted, according to the forward and backward movements of the rack, to be moved upwardly and downwardly through the feed screw to lift and lower the continuous casting nozzle.

3. A continuous casting nozzle comprising a protrusion engageable with the second engagement portion of the continuous-casting-nozzle support apparatus as defined in claim 1.

4. The continuous-casting-nozzle support apparatus as defined in claim 1, wherein the holding mechanism includes:

a rotary shaft coupled to the stationary column turnably about the stationary column;

an extendable and retractable support arm coupled to the rotary shaft turnably in a horizontal direction and swingably in an upward-downward direction, about the rotary shaft; and an actuator disposed between the rotary shaft and the support arm and adapted to swingingly move the support arm in the upward-downward direction, and wherein:

the lifting mechanism is coupled to the support arm turnably in a horizontal direction; and the supporting mechanism is coupled to the lifting mechanism.

5. The continuous-casting-nozzle support apparatus as defined in claim 2, wherein the holding mechanism includes:

a rotary shaft coupled to the stationary column turnably about the stationary column;

an extendable and retractable support arm coupled to the rotary shaft turnably in a horizontal direction and swingably in an upward-downward direction, about the rotary shaft; and an actuator disposed between the rotary shaft and the support arm and adapted to swingingly move the support arm in the upward-downward direction, and wherein:

the lifting mechanism is coupled to the support arm turnably in a horizontal direction; and the supporting mechanism is coupled to the lifting mechanism.

6. A sliding nozzle system comprising the continuous-casting-nozzle support apparatus as defined in claim 1, and a sliding nozzle device having a sliding metal frame formed with the first engagement portion hookable by the hooking device of the continuous-casting-nozzle support apparatus.

7. A sliding nozzle system comprising the continuous-casting-nozzle support apparatus as defined in claim 2, and a sliding nozzle device having a sliding metal frame formed with the first engagement portion hookable by the hooking device of the continuous-casting-nozzle support apparatus.

8. A continuous casting nozzle comprising a protrusion engageable with the second engagement portion of the continuous-casting-nozzle support apparatus as defined in claim 2.

* * * * *